United States Patent [19]

Ruckstuhl et al.

[11] 4,266,676

[45] May 12, 1981

[54] APPARATUS FOR SEPARATION OF MATERIAL OF HETEROGENEOUS CHARACTER

[75] Inventors: Konrad Ruckstuhl, Littleton; Serafin L. Silvano; Kurt W. Beier, both of Aurora, all of Colo.

[73] Assignee: SPM Group, Inc., Englewood, Colo.

[21] Appl. No.: 37,729

[22] Filed: May 10, 1979

[51] Int. Cl.[3] ..... B07B 13/05

[52] U.S. Cl. ..... 209/672

[58] Field of Search ..... 209/672, 667, 668, 350, 209/351, 361

[56] References Cited

U.S. PATENT DOCUMENTS

| | | | |
|---|---|---|---|
| 2,257,352 | 9/1941 | Silver | 209/672 |
| 2,370,539 | 2/1945 | Hadecker | 209/668 |
| 2,743,813 | 5/1956 | Erickson | 209/672 X |

FOREIGN PATENT DOCUMENTS

| | | | |
|---|---|---|---|
| 618154 | 9/1935 | Fed. Rep. of Germany | 209/672 |
| 618964 | 9/1935 | Fed. Rep. of Germany | 209/672 |
| 658699 | 4/1938 | Fed. Rep. of Germany | 209/672 |
| 924266 | 7/1947 | France | 209/672 |

*Primary Examiner*—Allen N. Knowles

*Attorney, Agent, or Firm*—Horace B. Van Valkenburgh; Richard D. Law

[57] ABSTRACT

A separator for material which includes components of different specific gravities and sizes, includes a series of spaced, parallel shafts disposed in essentially the same plane, which may be tilted upwardly. A series of non-circular discs, such as elliptical, three lobed, etc., are mounted on each shaft and interspaced with the discs on adjacent shafts. A pipe, on which the discs are mounted, or a spacer mounted on the shaft provides circular surfaces between the discs which clear the projections of the discs of adjacent shafts but when the disc surfaces between the projections come opposite the pipe or spacer, cause holes or spaces to be produced, through which material may fall, if sufficiently small. As the discs rotate, they not only cause the holes to open and close, but also propel the material both upwardly and forwardly. The discs may be mounted on a shaft in a spiral relation, so that not only is the material pushed upwardly and forwardly, but also laterally. Several sets of discs may be used, with the discharge end of one set being above the receiving end of the next set, so that the material will tend to be turned over as it falls from one set to the next. A paddle may be used to enhance the turning, while the paddle may be rotated at a sufficient speed to break glass bottles or the like. The holes produced by the rotating discs may increase in size from one set to the next.

22 Claims, 25 Drawing Figures

21
25
22
D
16
10

22
D
21
26

10
13
24
28
29
31
30

10
D'
35
21
22

22
35
D'
21
10

22
D'
21
37
36

43
44
45
42
41
40
10
35

40
41
42
35
43
44
45
10

Fig-19
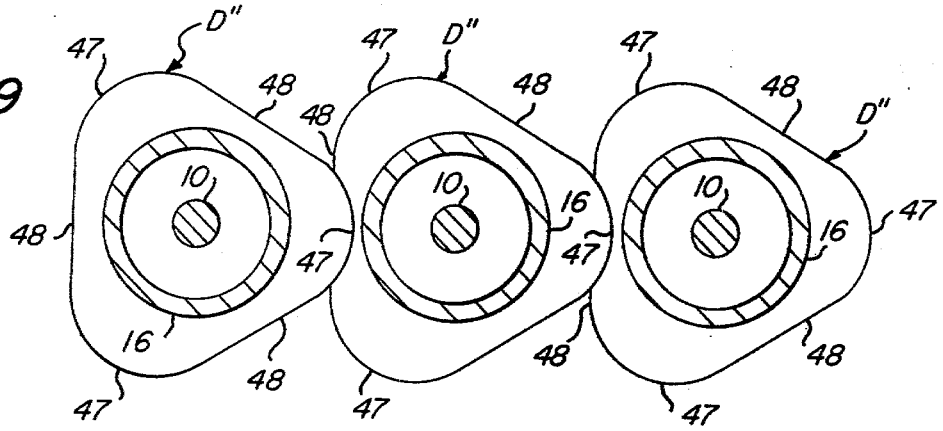
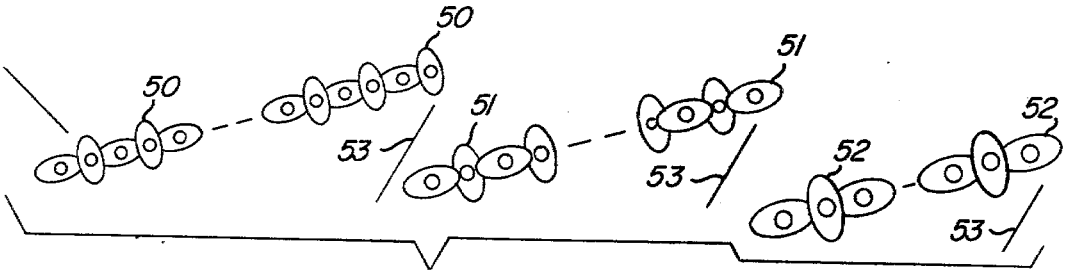
Fig-20
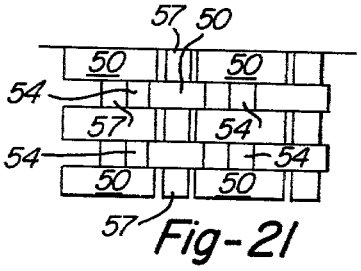
Fig-21
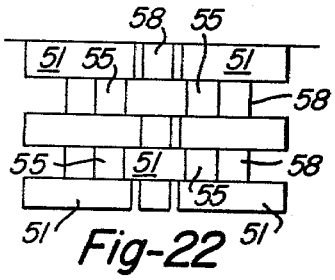
Fig-22
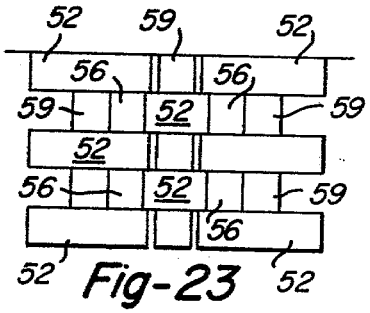
Fig-23
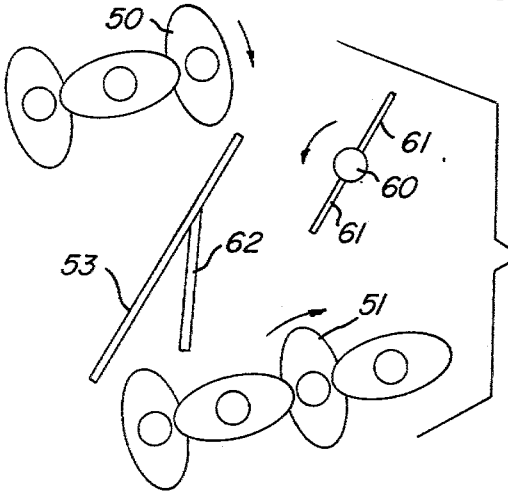
Fig-24
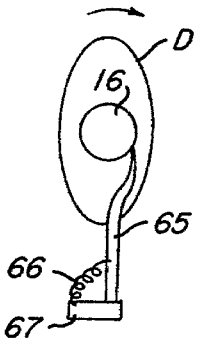
Fig-25

APPARATUS FOR SEPARATION OF MATERIAL OF HETEROGENEOUS CHARACTER

This invention relates to apparatus for separating material of a heterogeneous character, i.e. containing components of different specific gravities and sizes, and more particularly for the pre-separation of refuse or similar material containing both heavier and lighter articles or material, as well as smaller and larger articles or material.

BACKGROUND OF THE INVENTION

A large component of municipal refuse, for instance, may comprise paper products, such as newspaper, cardboard in both flat and carton form, and the like. However, there is also and often in varying proportions, material such as waste metal particles and metal articles, both magnetic and non-magnetic, food waste, dirt or soil and articles or particles of glass and other materials. Due to the variation in the amount of the various types of material, often depending upon the area in which the refuse has been collected, it is quite difficult to find adequate separating devices, since those which may be highly effective are particularly adapted for and therefore essentially limited to the separation of smaller or larger fractions only. Since heavier materials are often intermixed with lighter materials, either or both of which may also vary considerably in size, conventional disc screens and so-called "wobbler" separators having spiral ribs on parallel shafts have been found to be unsuitable for the effective separation of refuse into both light and heavy components, as well as different sizes. Thus, heavier components tend to become intermized with large articles, such as newspapers or cartons, and thereby tend to be carried over the holes through which they are intended to drop. Such equipment is also quite heavy, with relatively heavy drives and substantial inertia, requiring considerable horsepower to start up in the event of jamming of material between moving parts or complete stoppage and hand cleaning operation. Also, trommel screens, to be effective, must be equipped with large screening surfaces and openings of four inches or more in diameter, which results in an unduly large proportion of light fractions passing through, thereby substantially reducing the yield of the light fractions.

Erickson U.S. Pat. No. 2,743,813 discloses a device for separating oversized particles from mine run ores having a series of horizontally disposed, parallel shafts which are hollow and have an elliptical configuration. Each shaft is provided with a series of transverse ribs which follow the transverse contour of the shaft, while the alternate shafts are placed at positions 90° apart from the remaining shafts. The ribs of all of the shafts are in longitudinal alignment, the function of the ribs being primarily to guide the material moved by the rotating shafts. Johlige U.S. Pat. No. 1,941,147 discloses a classifying apparatus for ore, coal, stones and the like which includes a series of horizontally disposed, square, parallel shafts with different types of discs in lateral sets. These discs include spaced, circular discs mounted in different off-center positions on the same shaft, but in corresponding positions on all shafts. In one modification, elliptical discs are mounted centrally on the shafts, with alternate elliptical discs mounted at 90° to the remainder. In another modification, all of the discs are three-sided, with each side being an arc, and are mounted at 60° apart on each shaft. All of the discs on the respective shafts are in longitudinal alignment with each other. Conway U.S. Pat. No. 3,028,957 discloses an ore separator having a parallel series of hollow, elliptical rollers with a 90° angular relationship between adjacent rollers and equally spaced elliptical ribs mounted on each roller, with all of the ribs in longitudinal alignment.

Among the objects of the present invention are to provide a separator which will handle a relatively large variety of different material, particularly when intermixed; to provide such a separator which will handle such intermixture of materials which may vary in the proportion of the sizes, as well as lighter or heavier materials; to provide such a separator which will separate the heavy fraction with a minimum of loss and secure the highest possible yield of light fractions; to provide such a separator which is particularly adapted to handle refuse; to provide such a separator which may be stopped and restarted with a minimum of horsepower; to provide such a separator which need not be unloaded in order to restart or eliminate a jam caused by a piece of refuse becoming jammed between two moving parts; to provide such a separator, the drive of which may be reversed in direction, in order to eliminate a jam; to provide such a separator which is adapted to handle relatively large load variations; to provide such a separator which is relatively simple in construction and economical to build; and to provide such a separator which is efficient and effective in use.

SUMMARY OF THE INVENTION

A series of similar non-circular discs are mounted on spaced, parallel shafts in a common plane with the discs of one shaft interspaced with the discs of adjacent shafts. Each disc has a plurality of first convex surfaces in equally spaced, radial positions and extending from a shaft or a spacer surrounding the shaft a greater distance than second surfaces which are interspaced between the first surfaces. A preferred contour of the discs is elliptical, although other configurations, such as a three lobe type, may be utilized. The spacing between the shafts is such that, when one end of an elliptical disc reaches a point opposite the periphery of an adjacent shaft or a spacer thereon, only a small clearance is produced, but when either side of the disc reaches a position opposite an adjacent shaft or spacer thereon, a hole is produced through which smaller components may drop. The holes are alternately opened and closed by the rotation of the discs, which enhances the separation. The shafts are rotated in unison in the same direction, so that the first surfaces, such as the ends of elliptical discs, will move in a rearward to forward direction above the shaft to propel a bed of material forwardly, such bed being composed of heterogeneous material containing components of different specific gravities and sizes. The widths of the interspaced discs and/or the distance between the second surfaces, such as the sides of elliptical discs, may vary to decrease or increase the size of the holes at different positions or locations along the path of the bed. The thickness of the discs and the consequent spacing between adjacent interspaced discs is such that the maximum size of piece which will fall through is determined by the sides of the discs and the opposed shaft or spacer. Several series, such as three, of shafts and discs with each in an upwardly inclined plane, may overlap with the next forward series, so that the material propelled forwardly by one series will drop downwardly onto the lower end of the next series. A reversal of the components of the bed tends to be produced, so that small particles supported by a paper component having a relatively large area on top of the bed, tends to fall to the bottom of the bed when the paper turns over. Other components, such as cardboard boxes, which may contain much smaller particles, tend to be turned upside down in falling from the upper end of one series onto the lower end of the next series, so that the contents of the cardboard box tend to be spilled out and thus fall through the holes. Also, the size of the holes of the three sets of discs may vary, such as to permit components smaller than aluminum cans to fall through the holes of the first and second sets, and larger components, such as the aluminum cans, to fall through the holes of the third set. Thus, the aluminum cans will be discharged with larger components and obviate difficulties in the attempted separation of aluminum cans from small pieces of paper, for instance, as by an air stream or jet.

The apparatus of this invention is particularly adapted to be utilized as a pre-separator for the refuse treatment apparatus and method disclosed in the application of Konrad Ruckstuhl, Ser. No. 867,698 filed Jan. 9, 1978 and entitled "Method of and Apparatus for Treating Waste Material", now U.S. Pat. No. 4,203,755.

THE DRAWINGS

Additional features and details will become apparent from the description which follows, taken in conjunction with the accompanying drawings, in which:

FIG. 19 is a fragmentary section similar to FIG. 7 but showing three lobe discs mounted on a series of adjacent shafts.

FIG. 20 is a condensed, partially schematic side elevation of three sets of discs in series, with each set inclined upwardly and overlapping the next set.

FIG. 21 is a fragmentary top plan view, on an enlarged scale, of a portion of the discs and spacers of the first set of FIG. 20.

FIG. 22 is a similar fragmentary top plan view, on an enlarged scale, of a portion of the discs and spacers of the second set of FIG. 20.

FIG. 23 is a similar fragmentary top plan view, on an enlarged scale, of a portion of the discs and spacers of the third set of FIG. 20.

FIG. 24 is a fragmentary side elevation, on a further enlarged scale, showing a shaft and blades for turning objects as they fall from one set of discs to the next, in the arrangement of FIG. 20.

FIG. 25 is a side elevation showing a wiper which may be used to remove elongated articles tending to wind around a shaft or spacer between discs.

PREFERRED EMBODIMENT OF THE INVENTION

Figure 1:
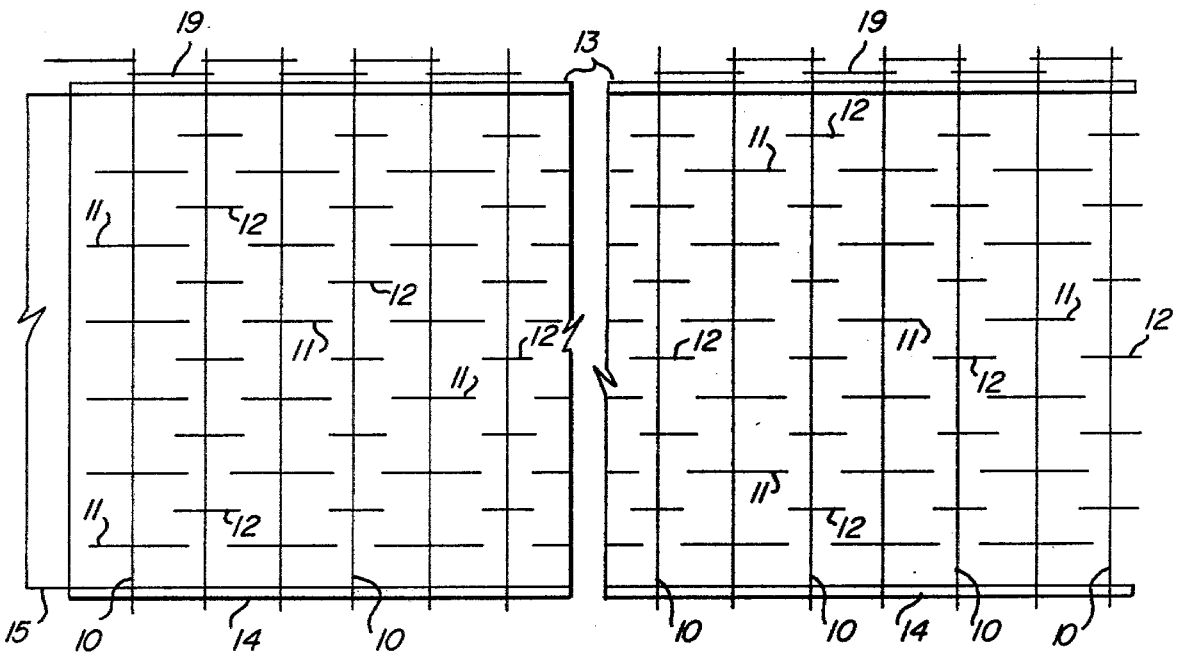
FIG. 1 is a diagrammatic top plan view illustrating generally the construction of the separator of this invention.
Figure 2:
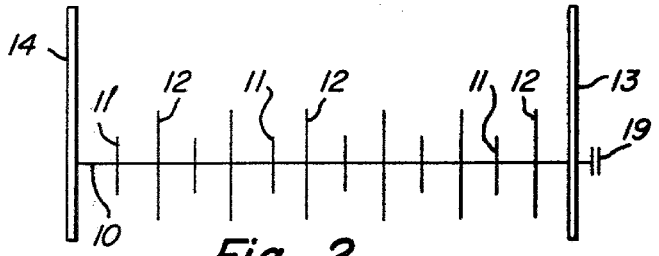
FIG. 2 is a diagrammatic rear elevation of the separator of FIG. 1.
Figure 3:
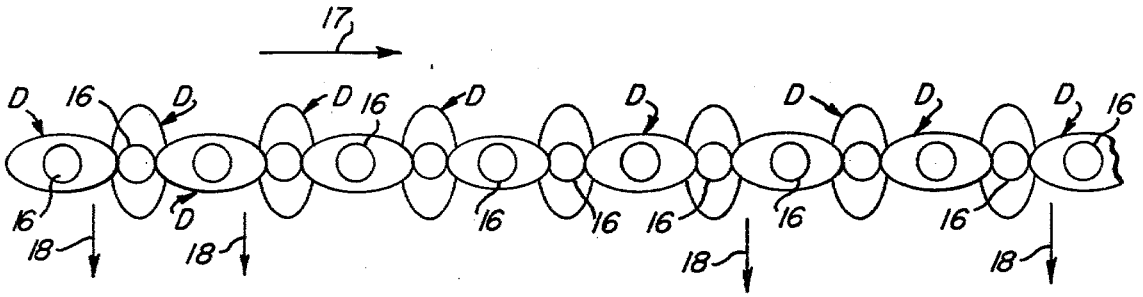
FIG. 3 is a side elevation of the operating discs and associated parts of the separator of FIG. 1.

The apparatus, illustrated diagrammatically in FIGS. 1 and 2, includes a series of shafts 10 extending in a parallel relation, spaced essentially equally from each other in the same plane, and carrying a series of non-circular discs represented by lines 11 and 12 mounted on alternating shafts in different radial positions and extending between side walls 13 and 14. The discs D of the preferred embodiment, as in FIG. 3, are generally elliptical in shape, as will hereinafter appear, although other suitable configurations may be utilized, such as one having a plurality of first convex surfaces in equally spaced, radial positions and having a greater extension from the shaft means than second surfaces interspaced between the first surfaces. In the instantaneous position shown in the top plan view of FIG. 1, the greater length of lines 11 represents the center lines of discs whose longest dimension extends in a horizontal direction, i.e. longitudinally of the apparatus, whereas the lines 12 represent the discs on alternating shafts whose shortest dimension extends in the horizontal direction and whose longest dimension therefore extends in a transverse or upright direction. As viewed from the end, as in FIG. 2, the longer lines 12 represent discs shown in FIG. 1 as having the greater dimension upright, while the shorter lines 11 represent discs whose longer dimension extends horizontally and whose shorter dimension is now seen as upright. When the discs are elliptical, the longer lines of FIGS. 1 and 2 correspond to the major axis of the ellipse and the shorter lines to the minor axis. At the front or intake end, a feed apron 15 may be mounted extending at a suitable angle so that the material to be separated may slide down the feed apron onto the discs.

In accordance with this invention, the discs D on one shaft are interspaced with the discs of each adjacent shaft and have substantially the same thickness, so that the discs will rotate with the respective shafts, in turn rotated in a direction to move the discs upwardly from the front toward the rear to move the material from the intake end of feed apron 15 to the opposite or discharge end. In general, as the discs rotate, the material fed onto them will be propelled not only forwardly, but also upwardly, so that the various layers and strata of the material will tend to be disturbed and larger pieces of material, such as newspapers, cardboard or the like, will generally be propelled toward the discharge end of the separator, while smaller material will, when reaching the bottom of the bed of material, fall through the holes between the rotating discs, alternately uncovered as the discs rotate. While the forward movement imparted to the bed of material by the discs propels the larger fractions forwardly to the discharge end of the discs, the upward movement imparted to the bed of material will tend to cause smaller components to seek their way downwardly through the bed, for separation by falling through the alternately opened holes. The operation of the discs represented by lines 11 and 12 of FIGS. 1 and 2 is also illustrated generally in FIG. 3, in which each set of discs D on each shaft is mounted on a pipe 16 which extends through the spaced discs on that shaft and reduces the size of the aperture uncovered as the discs on the adjacent shafts move upwardly or downwardly past the pipe, between a longitudinal or horizontal and a transverse or upright position. The general movement of the material placed on the discs is in the direction of the arrow 17, i.e. forwardly from the feed apron 15 of FIG. 1, while the direction of discharge of the smaller or fine material is indicated by the arrows 18. The shafts 10 and the discs D along with them, are rotated by a drive mechanism 19, indicated in FIGS. 1 and 2. For movement of the material in the direction of the arrow 17, each shaft 10 is rotated in a clockwise direction, as viewed in FIG. 3.

Figure 4:
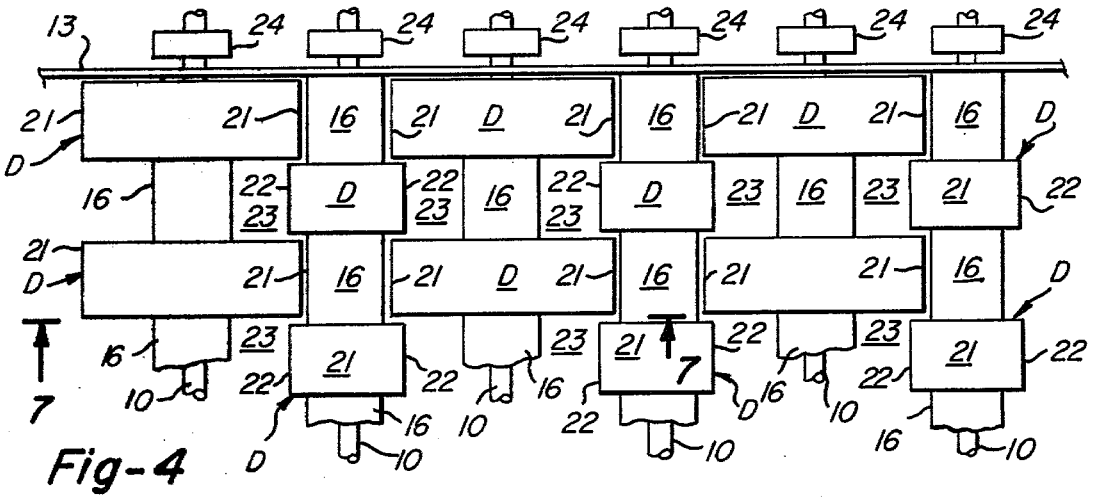
FIG. 4 is a top plan view of a portion of the separator parts of FIG. 3, on an enlarged scale and illustrating an instantaneous position of certain parts including spaced, parallel shafts rotating in the same direction and non-circular discs mounted thereon.
Figure 6:
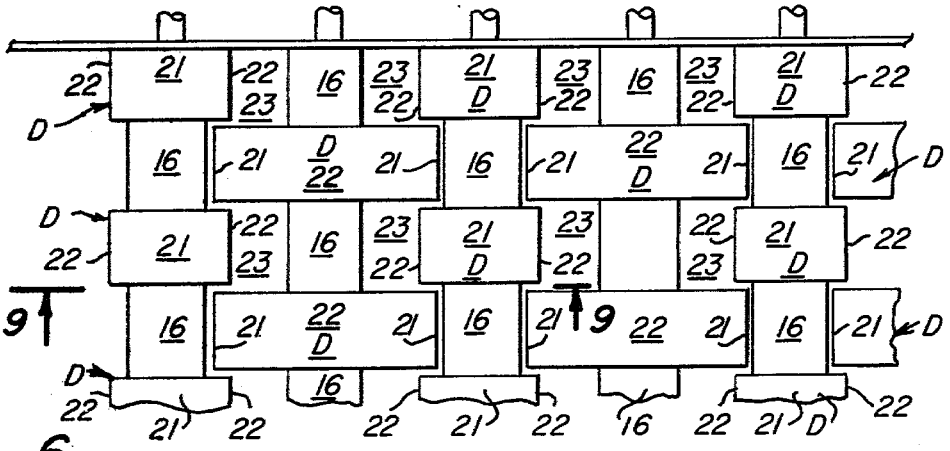
FIG. 6 is a top plan view similar to FIG. 4, but illustrating the instantaneous position of the parts after rotation of the shafts through 90°.
Figure 7:
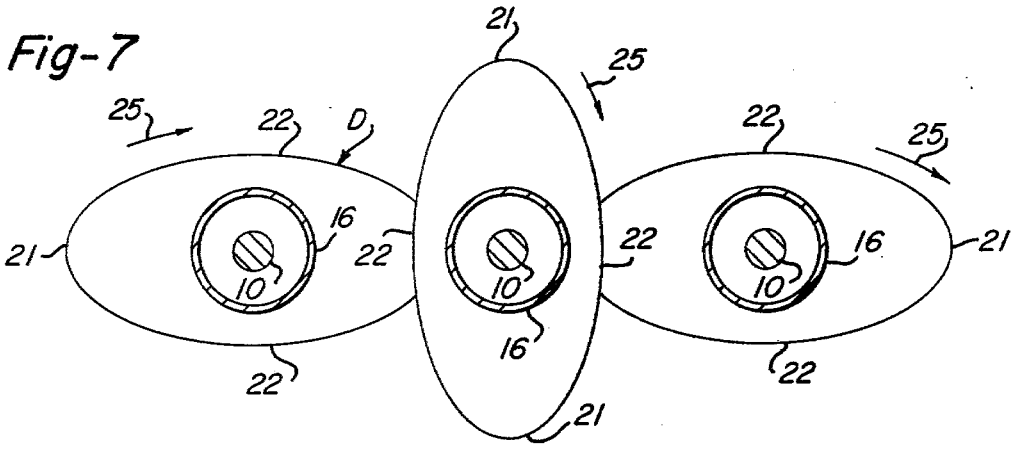
FIG. 7 is a fragmentary section taken along line 7—7 of FIG. 4 on a further enlarged scale.
Figure 8:
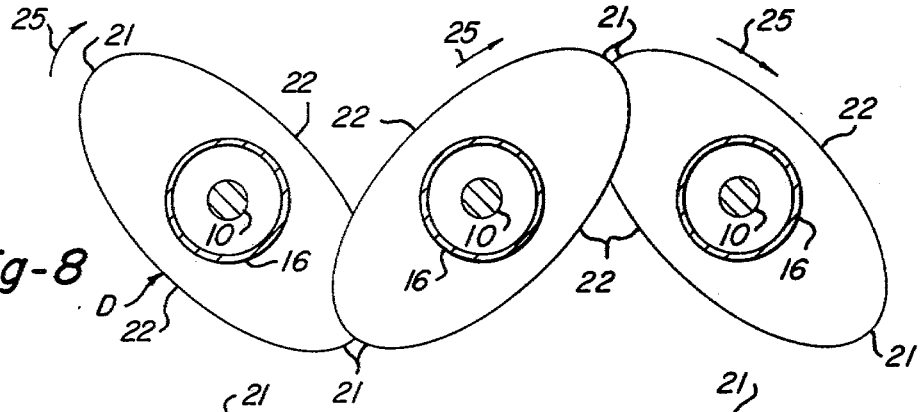
FIG. 8 is a fragmentary section similar to FIG. 7, but taken along line 8—8 of FIG. 5.

As shown in FIGS. 4 and 7, the opposite ends 21 of discs D having the longer dimension in FIG. 4, during rotation, will move upwardly or downwardly, past the pipe 16 on the preceding or succeeding shaft, with a slight clearance, while the clearance between the opposite sides 22 of discs D on alternate shafts and the pipe 16 on the shaft preceding or succeeding such alternate shafts is at a maximum in the transverse or upright position, i.e. at holes 23. As indicated previously, the holes 23 determine the maximum size of object or article which will fall through. It is through these holes that the smaller material falls, in the direction of arrow 18 of FIG. 3, and thereby become separated from the larger material which is propelled forwardly and upwardly by the rotating discs. As in FIG. 4, the shafts may be supported by bearings 24 outside the respective side wall 13 or 14, with the drive train 19 being outside the adjacent bearings. As in FIGS. 5 and 8, when the shafts have rotated through 45° in the direction of arrows 25, holes 23 have begun to open between the discs whose ends 21 were formerly horizontal and the adjacent pipe 16, while the holes 23' between the discs whose ends 21 were formerly upright have begun to close. As in FIGS. 6 and 9, when the discs have rotated through 90° from the position of FIGS. 4 and 7, they will then be in the opposite position from FIGS. 4 and 7, i.e. the discs whose ends 21 were formerly horizontal will now be vertical and the discs whose ends 21 were formerly vertical will now be horizontal. Also, the holes 23 will then be between the sides 22 of the discs whose ends 21 are now vertical and the pipe 16 on each adjacent shaft. As in FIG. 10, when the discs have rotated 135° from the position of FIGS. 4 and 7, i.e. 45° from the position of FIGS. 6 and 9, a position opposite to that of FIG. 8 will be reached. Finally, when the discs have rotated 180° from FIGS. 4 and 7, as in FIG. 11, the same relative position will be reached, although the underside 22 of a disc formerly on the bottom will now be on the top and the end 21 of a disc formerly beneath will now be on top. As will be evident, during rotation of the discs from the position of FIGS. 4 and 7, the holes 23 present therein will disappear when the position of FIGS. 6 and 9 is reached and an alternate set of holes 23 will appear, while further rotation to the position of FIG. 11 will cause the alternate holes to disappear and holes in the relative position of FIGS. 4 and 7 to appear again.

Figure 9:
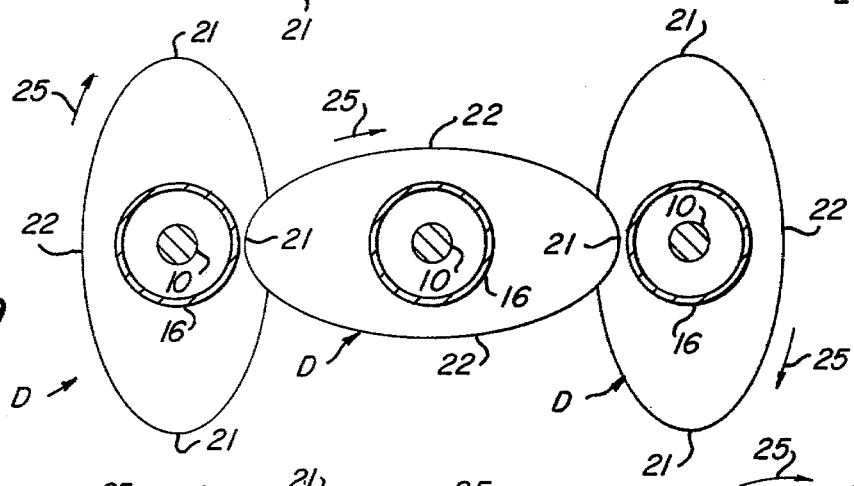
FIG. 9 is a fragmentary section similar to FIG. 7, but taken along line 9—9 of FIG. 6.
Figure 10:
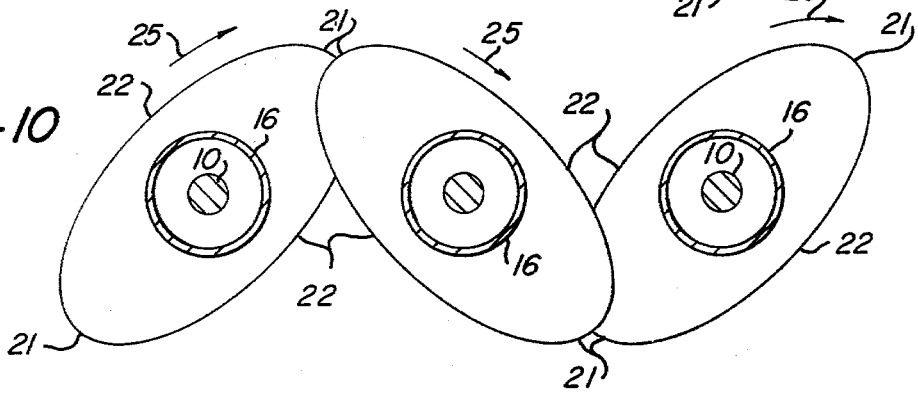
FIG. 10 is a fragmentary section similar to FIG. 7, but illustrating the instantaneous position of the parts after rotation of the shafts through 135°.
Figure 11:
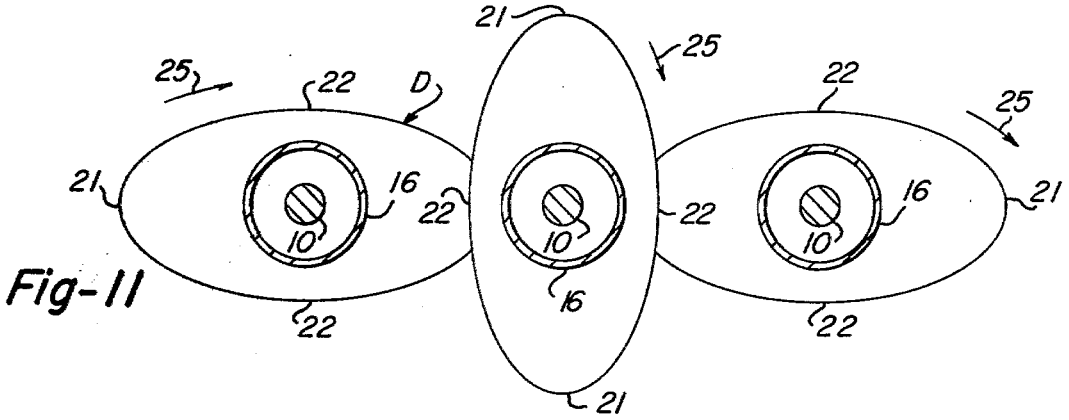
FIG. 11 is a fragmentary section similar to FIG. 7, but showing the position of the parts after movement of the shafts through 180°.

It will be noted that, as the discs corresponding to those shown at the center of FIG. 7 rotate from the position of FIGS. 4 and 7 to the position of FIGS. 6 and 9, the upper end of those discs will move downwardly toward the pipe 16 on the next shaft 10, facilitating the passage of small material through the hole 23. Of course, the lower end of the center disc of FIG. 7, when moving to the position of FIG. 9, will move upwardly toward the pipe 16 on the previous shaft 10 and will tend to move the material above it upwardly, thereby tending to impel upwardly smaller material above it, although some of the smaller material which has reached the lower portion of the bed of material will slide along the disc until the position of FIG. 11 is reached, when that end of the center disc will move downwardly to open up a hole 23.

Figure 12:
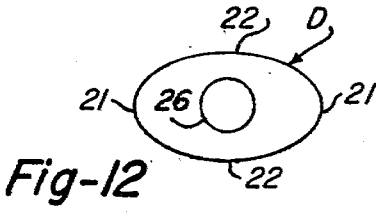
FIG. 12 is a side elevation of a disc of FIGS. 4–11.
Figure 13:
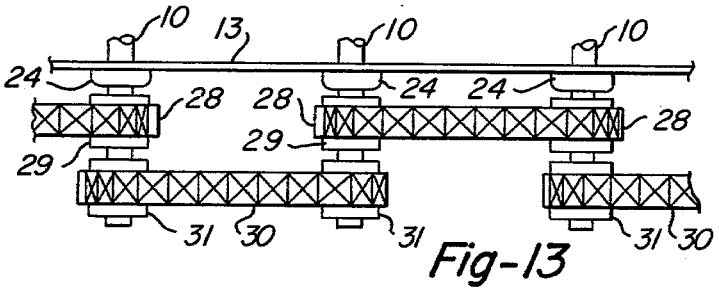
FIG. 13 is a fragmentary top plan view showing a portion of the drive mechanism connecting the shafts.

As illustrated in FIG. 12, the ends 21 of each elliptical disc D is arcuate about a shorter radius than the arcuate sides 22. Although any desirable proportion between the length and height of the discs may be utilized, as illustrated in FIG. 12, a proportion of two to one has been found desirable in several instances. To accommodate pipe 16, each disc may be provided with a circular, central hole 26, corresponding in diameter to the outer diameter of pipe 16. Discs D may be attached to pipe 16 in any suitable manner, as by spot welding, keying or the like. Also, each pipe 16 may be mounted on a shaft 10 by an annular block at each end of the shaft, or the shafts 10 may merely be stub shafts, each extending from an annular attachment block mounted at an end of a shaft 10. Each shaft or stub shaft extends through a wall 13 or 14 and through a bearing 24, with the shafts or stub shafts on one side, as at wall 13, extending to the drive train 19. As in FIG. 13, the drive train may include a series of chains 28, each of which extends around a pair of inside sprockets 29 mounted on an adjacent pair of shafts 10, and a series of chains 30, each of which extends around a pair of outside sprockets 31 mounted on an alternating adjacent pair of shafts 10. A sprocket on the first shaft may, of course, be driven by a chain which also extends around a sprocket on a shaft of an electric or other driving device. The sprockets are driven so that all of the shafts and the discs along with them, will rotate in the same direction, as by the upper reach of each chain moving in the direction of an arrow 32.

Figure 14:
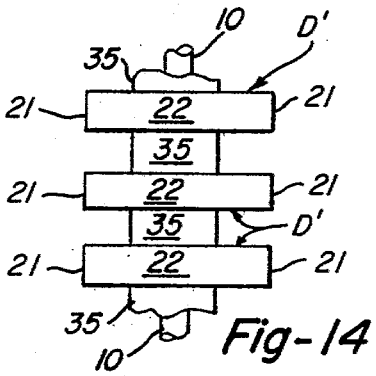
FIG. 14 is a fragmentary top plan view of a construction in which a spacer is placed on the shaft between each adjacent pair of elliptical discs.
Figure 15:
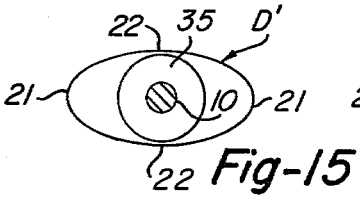
FIG. 15 is a cross section taken along line 15—15 of FIG. 10.
Figure 16:
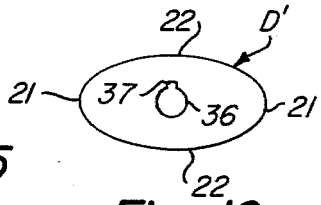
FIG. 16 is a side elevation of a disc of FIG. 15.

As illustrated in FIGS. 14-16, an alternative construction may comprise a series of discs D' mounted directly on a shaft 10, with a spacer 35 encircling the shaft between each pair of discs. Both the spacers and the discs are preferably centered on the shaft and the spacers have an annular configuration, as in FIG. 15, as well as a thickness slightly greater than the thickness of the discs, in order to provide lateral clearance for the discs on adjoining shafts. As in FIG. 16, a central hole 36 in each disc D' may be provided with a keyway 37 for attachment of the disc to the shaft. Since the spacers 35 have a circular periphery, the center of which is at the center of the shaft, there is no need to key or otherwise attach the spacers to the shaft. As illustrated, the spacers extend outwardly nearly to each side edge 22 of disc D' and are thus particularly useful when the diameter of the circular area between the discs is to be equal to or slightly less than the transverse dimension of the disc. As will be evident, an enlargement of pipe 16 of FIGS. 4–11 to approach the side edges 22, for instance, would cause hole 26 of FIG. 12 to be so large that the discs, at the side edges 22, might be so thin that breakage might readily occur.

Figure 17:
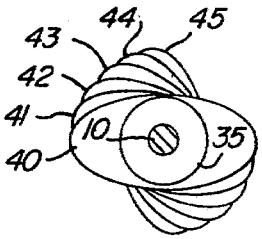
FIG. 17 is an end elevation of a series of discs which are mounted on the same shaft, but instead of the major axes of the discs being in alignment, the angular relation between the axes changes so that a spiral relation is produced to move material also laterally from one side of the separator to the other, as well as longitudinally.
Figure 18:
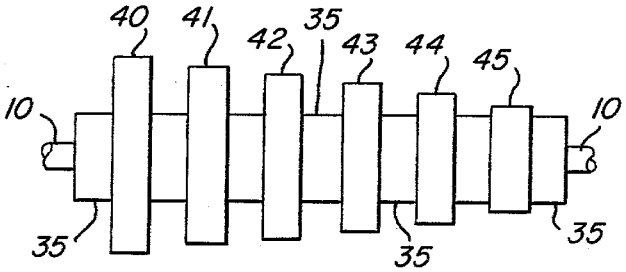
FIG. 18 is a top plan view of the shaft and discs of FIG. 17.

As illustrated in FIGS. 17 and 18, the consecutive discs on each shaft may be spaced apart angularly, so as to produce a lateral, as well as a forward, movement of the material. This may be particularly desirable when the holes 23 adjacent one side, as adjacent wall 13 or 14, are smaller or larger, the former to limit the size of the material which may drop through, and the latter to increase the size of the material which may drop through. One instance of the latter is when cans, for instance, are mixed with smaller material and are more effectively removed by permitting the smaller material to first drop off, then separating the cans at one side. Such a construction is exemplified by the angular positions 41, 42, 43 44 and 45 of the discs D' on the shaft 10. In the position shown, the difference in angularity between the discs is 15°, although a variation in such difference in angularity may be utilized, such as up to 45°.

An alternative configuration of the discs which may be utilized, when it is desirable to produce a lesser rate of movement of the material from the inlet toward the discharge end, as well as provide smaller holes uncovered by the discs, is illustrated in FIG. 19. Each of discs D" is illustrated as mounted on a pipe 16 which is supported and rotated by a shaft 10, although a construction similar to FIG. 16 may be utilized. Discs D" are constructed as essentially three lobe discs, having three convex arcuate projections 47 and three relatively flat sides 48. The apices of the convex, arcuate projections 47, as well as the flat sides 48, are located 120° apart. Also, the convex projections 47 are symmetrical about their center lines. As shown in FIG. 19, a set of discs on one shaft is angularly spaced 60° from the discs on each adjacent shaft, so that the projections 47, as they approach the pipe 16 on either adjacent shaft, will close the space, which will open to its fullest extent when a flat side 48 is directly opposite the pipe 16 on either adjacent shaft.

In a further construction of this invention, the shafts on which each of three sets of discs such as discs 50, 51 and 52 of FIG. 20, are mounted are in parallel relation but disposed in an upwardly inclined plane, as at an angle on the order of 12° to 15°, and overlapping the next set, so that the material falling off the upper discharge end of the upwardly inclined first set of discs 50 will drop onto the lower end of the second set of discs 51 and, similarly, the material falling off the upper discharge end of the second set of discs 51 will drop onto the lower end of the third set of discs 52. The impetus given to the bed by the respective discs and the drop to the next set of discs is preferably sufficient that the bed of material will tend to be turned over as it drops from one set of discs to the next. The upper end of each set of discs overlaps the lower end of the next set of discs, respectively, but a slide 53 extends downwardly and rearwardly underneath the upper end of the first and second sets of discs, so that any material falling through the spaces between the discs 50, 51 of the first and second set of discs, or stages, adjacent the discharge end will move down the slide 53 for discharge, rather than being deposited on the next set of discs.

Such a construction is particularly adapted to be utilized when there are objects, such as cardboard boxes or cans carried along with the bed of material moved along by the discs, which objects may have other objects in them, such as small particles of dirt or the like, which would tend to remain in the boxes or cans as the boxes or cans are moved to the discharge end of the apparatus of FIG. 1, for instance. Thus, the tendency of the objects in the bed to turn over as they pass from the first stage discs 50 to the second stage discs 51, as well as from the second stage to the third stage discs 52, insures that the particles carried by the boxes or cans will fall out of them as they turn over. In addition, small particles or objects will move from the top to the bottom of the moving bed, if carried on top of a large object, such as a sheet of newspaper or the like. Thus, in addition to turning over boxes, cans or the like, the tendency of the top of the bed to reverse and become the bottom when falling over the discharge end of the first and second stages contributes to the facility with which smaller particles and also smaller objects may be separated.

Figure 5:
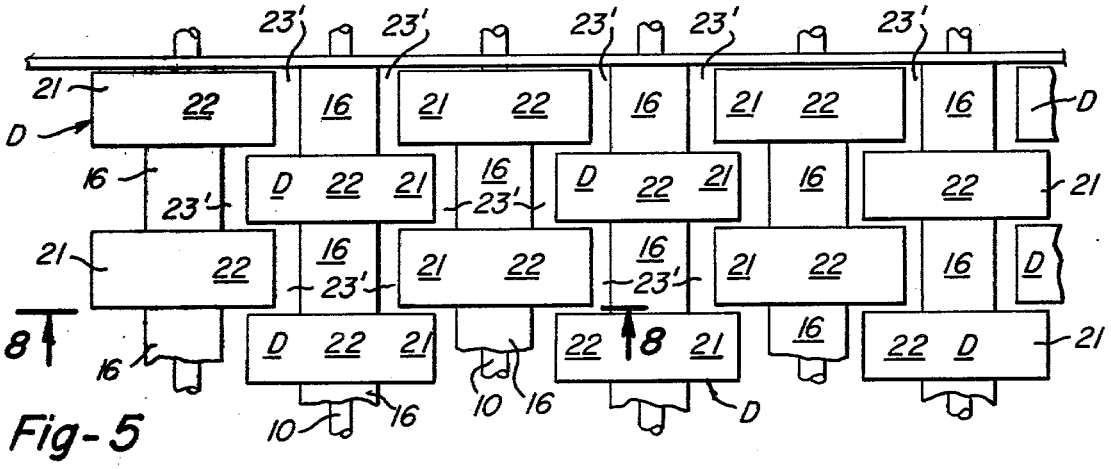
FIG. 5 is a top plan view similar to FIG. 4, but illustrating the instantaneous position of the parts after rotation of the shafts through 45°.

In addition, a variation in the size of the holes or apertures corresponding to holes 23 of FIGS. 4–6 and produced by the discs of the respective stages may be utilized, such as smaller holes 54 produced by the discs 50 of the first stage, as in FIG. 21, while the discs 51, 52 of the second and third stages, as in FIGS. 22 and 23, may produce holes 55 and 56, respectively, larger in size or increase consecutively. One way in which the difference in holes may be provided, such as smaller holes 54 formed by the first stage discs 50, intermediate holes 55 formed by the second stage discs 51 and larger holes 56 formed by the third stage discs 52, is by variation in the length and thickness of the discs of each stage. Thus, the distance between the apices of the ends of each of the first stage discs 50 may be less than the distance between the ends of the second stage discs 51, in turn less than the distance between the ends of the third stage discs 52. In other words, the length of the discs may increase from the first stage discs through the third stage discs, as in FIGS. 22 and 23, such as successive increases on the order of 30% to 35%. The ratio of the length of the respective discs to the width of the discs may be approximately two to one, as before. The spacing between the supporting shafts depends upon the length of the respective discs and the diameter of the spacers 57, 58 and 59 for the respective discs, such as corresponding to pipe 16 of FIGS. 4–11 or spacers 35 of FIG. 15, which, in turn, depends on the desired lengths of the respective holes produced. To produce square holes, the thickness of each disc should correspond to the width of the corresponding hole.

In addition to the turning effect on the components falling from the upper end of one set of discs to the lower end of the next set of discs, a shaft 60 of FIG. 24 may be positioned forwardly of and below the last disc 50 of the first stage and carry a pair of oppositely disposed, radially positioned and longitudinally extending blades 61. Rotation of the shaft 60 in a direction toward the first stage produces a dual effect, both insuring the turning effect and causing the blades 61 to impact the falling and turning material, so as to break up articles of glass or similar material sufficiently to permit it to drop through the holes or spaces produced by the second stage discs, rather than being carried on to the third stage discs, even though a substantial proportion of glass may be sufficiently small to fall through the first stage discs 50. In order to prevent material being impelled rearwardly of the second stage discs 51, beneath the slide 53, an upright stop 62 may be suspended from the underside of the slide 53 and may be conveniently formed of flexible material, such as plastic, to permit it being moved aside to permit access to the discs rearwardly of the stop. A similar shaft having blades rotated away from the second stage but at a relatively slow speed may be provided adjacent the discharge end of the second stage discs 51, to insure the turning effect and thereby cause dirt or the like to drop out of a carton, for instance.

The difference in the size of the holes may be utilized to cause tin cans or the like to ride over the holes produced by the first and second stage discs, which may be proportioned so as to be smaller than a tin can or aluminum can, but to fall freely through the holes produced by the third stage discs. Thus, smaller articles, including lighter particles, such as paper and the like, will tend to be discharged through holes produced by the discs prior to the time the tin or aluminum cans are discharged. Those medium sized, light fractions, like paper, can be effectively separated from cans and the heavier fractions by low velocity air separation, requiring little air, less power and less filter back house capacity than other known methods.

In the event that difficulty is encountered with elongated articles, such as discarded rope, stocking or the like, winding around the pipes 16 of FIGS. 4–11 or the spacers 35 of FIGS. 14–16, suitable wipers 65 of FIG. 25 may be installed to engage the downward moving side of pipe 16 or spacer just below the centerline. Each such wiper 65 may be bowed toward the pipe or spacer, having a width corresponding thereto and be resiliently mounted, as at 66, as well as being formed of spring material, if desired. The resilient mounting 66 for each wiper 65 may be supported below the respective pipe or spacer by a transverse bar 67, or a pipe, tube or the like which is below the corresponding shaft or shaft means but spaced a sufficient distance from the spacer to provide adequate clearance for the projections of the discs D mounted on the shaft means, as they rotate below the spacers.

Although different embodiments of this invention and variations of particular parts have been illustrated and described, it will be understood that other embodiments may exist and other variations made, all without departing from the spirit and scope of this invention.

What is claimed is:

1. A separator comprising:

a series of spaced parallel shaft means mounted for rotation in essentially the same plane;

means for rotating said shaft means in the same angular direction;

a series of similar non-circular discs mounted on each shaft means in spaced relation, with the discs on one shaft means being interspaced between the discs of adjacent shaft means;

means adjacent the end discs on said shafts for restraining lateral movement of a bed of heterogeneous material containing components of different specific gravities and sizes;

said discs having a plurality of first convex surfaces in equally spaced, radial positions and having a greater extension from said shaft means than second surfaces interspaced between said first surfaces;

said discs on one shaft means being mounted in a different angular relation to said shaft means than said discs on adjacent shaft means, whereby rotation of said shaft means will rotate said discs and cause an upward movement of the first surface of said discs in the same angular direction to engage said components of said material and propel said components upwardly and move said bed forwardly in the direction of rotation of said discs above the axis of said shaft means and will produce openings as the position of said second surface of said discs moves opposite the adjacent shaft means, whereby smaller and heavier components tend to be moved downwardly in said bed and fall through said openings, said openings between such second surfaces and an opposite shaft means determining the maximum size of components of said material which will fall through said separator.

2. A separator as defined in claim 1, wherein:

said discs have a plurality of first surfaces and a plurality of second surfaces.

3. A separator as defined in claim 2, wherein:

said first surfaces and said second surfaces are 90° apart.

4. A separator as defined in claim 3, wherein:

said first surfaces are disposed in opposed positions on each disc; and said second surfaces are disposed in opposed positions on each disc.

5. A separator as defined in claim 4, wherein:

said discs are elliptical.

6. A separator as defined in claim 4, wherein:

the dimension of a disc across said first surfaces is generally twice the dimension of said disc across said second surfaces.

7. A separator as defined in claim 3, wherein:

the angular relation between discs on adjacent shafts is 90°.

8. A separator as defined in claim 2, wherein:

said first surfaces are in opposed positions on said disc to said second surfaces.

9. A separator as defined in claim 8, wherein:

said first surfaces are spaced 60° from said second surfaces.

10. A separator as defined in claim 9, wherein:

the angular relation between discs on adjacent shafts is 60°.

11. A separator as defined in claim 1, wherein:

said discs are of essentially the same thickness.

12. A separator as defined in claim 2, wherein:

said shaft means includes a circular spacing means between each pair of adjacent discs which extends outwardly to a point providing a slight clearance for the greatest radial extent of the opposite discs on the adjacent shafts.

13. A separator as defined in claim 12, wherein:
said spacing means is provided by an annular cylinder on which said discs are mounted.

14. A separator as defined in claim 12, wherein:
said shaft means includes a shaft on which said discs are mounted and having a diameter substantially less than that providing said clearance for the opposed discs on adjacent shafts; and
an annular spacer on said shaft between adjacent discs has an outer diameter of a dimension to provide said clearance.

15. A separator as defined in claim 1, wherein:
said discs on a shaft are mounted in progressive angular positions of the greater extensions thereof, whereby rotation of said discs tends to produce a lateral movement of said bed, in addition to said forward and said upward movements.

16. A separator as defined in claim 15, wherein:
the difference in angularity of the greater extensions of successive discs on a shaft is on the order of 15° to 30°.

17. A separator comprising:
a plurality of stages of discs, each stage except the last having its discharge end above but overlapping the receiving end of the next stage for discharge of material which does not fall through said stage onto the receiving end of said next stage; and
means for separately removing material which falls through said stage, each stage including:
a series of spaced parallel shaft means mounted for rotation in essentially the same plane;
means for rotating said shaft means in the same angular direction;
a series of similar non-circular discs mounted on each shaft means in spaced relation, with the discs on one shaft means being interspaced between the discs of adjacent shaft means;
means adjacent the end discs on said shafts for restraining lateral movement of a bed of heterogeneous material containing components of different specific gravities and sizes;
said discs having a plurality of first, convex surfaces in equally spaced, radial positions and having a greater extension from said shaft means than second surfaces interspaced between said first surfaces;
said discs on one shaft means being mounted in a different angular relation to said shaft means than said discs on adjacent shaft means, whereby rotation of said shaft means will rotate said discs and cause an upward movement of the first surface of said discs in the same angular direction to engage said components of said material and propel said components upwardly and move said bed forwardly in the direction of rotation of said discs above the axis of said shaft means and will produce openings as the position of said second surface of said discs moves opposite the adjacent shaft means, whereby smaller and heavier components tend to be moved downwardly in said bed and fall through said openings, said openings between such second surfaces and an opposite shaft means determining the maximum size of said material which will fall through said separator.

18. A separator as defined in claim 17, wherein:
each said stage is upwardly inclined, from the receiving end to the discharge end.

19. A separator as defined in claim 17, wherein:
an angular slide extends rearwardly and downwardly beneath each stage of discs except the last, from below the discharge end of the respective stage to a point rearwardly of the next stage.

20. A separator as defined in claim 19, including:
means adjacent the discharge end of at least one stage for impacting material discharged from said stage as it falls onto the next stage.

21. A separator as defined in claim 20, wherein said impact device includes:
a rotating shaft; and
a pair of oppositely disposed blades extending generally radially from said shaft.

22. A separator as defined in claim 17, wherein:
the said openings produced by said stages comprise smaller openings produced by the first stage and successively larger openings produced by succeeding stages.

* * * * *